US005528909A

United States Patent [19]

Tonakawa

[11] Patent Number: 5,528,909

[45] Date of Patent: Jun. 25, 1996

[54] WIRE FOR ORNAMENTS AND METHOD FOR MAKING THE SAME

[76] Inventor: Yasuhiko Tonakawa, Kaname-cho 2-chome, Toshima-ku, Tokyo 171, Japan

[21] Appl. No.: 264,396

[22] Filed: Jun. 23, 1994

[30] Foreign Application Priority Data

Jun. 30, 1993 [JP] Japan ..... 5-046159 U

[51] Int. Cl.[6] ..... A44C 5/00

[52] U.S. Cl. ..... 63/3

[58] Field of Search ..... 63/3, 4, 11

[56] References Cited

U.S. PATENT DOCUMENTS

| | | | |
|---|---|---|---|
| 243,793 | 7/1881 | Richards | 63/11 |
| 281,628 | 7/1883 | Holden | 63/11 |
| 306,936 | 10/1884 | Logan | 63/4 |
| 421,615 | 2/1890 | Riker | 63/11 |
| 2,554,629 | 5/1951 | Meyer | 63/3 |
| 3,804,307 | 4/1974 | Johnston | 63/3 |
| 4,305,262 | 12/1981 | Ferrara | 63/3 |
| 4,448,017 | 5/1984 | Stark | 63/4 |
| 4,753,086 | 6/1988 | Schmidt | 63/3 |
| 5,114,377 | 5/1992 | Cove Mercuri et al. | 63/3 |
| 5,148,689 | 9/1992 | Azrielant et al. | 63/4 |

FOREIGN PATENT DOCUMENTS

| | | | |
|---|---|---|---|
| 027462 | 12/1994 | WIPO | 63/3 |

*Primary Examiner*—Michael J. Milano
*Attorney, Agent, or Firm*—Jordan and Hamburg

[57] ABSTRACT

A wire for ornaments having a structure or construction thereof in which the wire is directly connected to a fastener, without the use of a bulky and heavy connecting element. Rings are integrally formed respectively at both ends of the wire which is made of metal and which joins or links jewels to each other. The rings have a diameter thereof which prevents the jewels from coming off, and are made to a flat shape or contour which is inconspicuous. Through bores 6 are formed respectively in the rings. A connecting ring of the fastener is passed through the through bore 6. The fastener is directly connected to the ring.

12 Claims, 3 Drawing Sheets

WIRE FOR ORNAMENTS AND METHOD FOR MAKING THE SAME

BACKGROUND OF THE INVENTION

1. Field of the Invention

The present invention relates to wires for ornaments such as necklaces, bracelets or the like and, more particularly, to a wire for ornaments which dispenses with connecting elements for jewels, which is light in weight, and which is also easy in handling.

2. Related Art and Prior Art Statement

In necklaces or bracelets in which jewels such as pearls, crystals, corals, onyxes, turquoises or the like are linked together, connecting threads such as silk, artificial or chemical fibers or the like have been used. However, there are cases where the connecting threads having such material generate looseness with the passage of time, and are snapped. For this reason, it has been preferred to use metallic wires made of stainless steel as the connecting threads. FIG. 9 of the attached drawings shows the conventional or prior-art ornament such as a necklace, a bracelet or the like which has been manufactured by the use of a metallic wire. A metallic wire 90 made of stainless steel or the like passes through a plurality of jewels 91 to thereby connect the jewels 91 to each other. The wire 90 has a forward end thereof to which a fastener (clasp) 93 is connected through a connecting element 92. The fastener 93 is detachably engaged with a hook element (not shown) which is mounted on the other end of the wire 90, in order to make the ornaments endless. The connecting element 92 serves as a decoration or an ornament as well. However, an original or essential object thereof is to connect the wire 90 and the fastener 93 to each other. This is because the wire 90 serving as the connecting thread and the fastener 93 cannot directly be connected to each other and, accordingly, are connected to each other through the connecting element 92.

FIG. 10 shows a structure or construction in which the connecting element 92 is used to connect the wire 90 and the fastener 93 to each other. The connecting element 92 has various components including an end piece 95, a first connecting piece 96, a second connecting piece 97 and a spacer piece 98. First, the end piece 95 is fixedly mounted on the forward end of the wire 90 by soldering. Meanwhile, a U-shaped pin 99 is connected to the fastener 93. The U-shaped pin 99 is inserted into the first connecting piece 96. Inserted forward ends of the U-shaped pin 99 are caulked. Thus, the fastener 93 and the first connecting piece 96 are connected to each other. Subsequently, the wire 90 is caused to pass through the second connecting piece 97, and the jewels 91 are mounted on the wire 90. Subsequently, the second connecting piece 97 is inserted into the spacer piece 98. Under such state or condition, the second connecting piece 97 and the first connecting piece 96 are engaged with each other, and are joined to each other. Thus, the wire 90 and the fastener 93 are connected to each other through the connecting element 92. However, since the spacer piece 98 of the connecting element 92 is processed in decoration, the connecting element 92 per se is recognized as being a decoration or an ornament.

In this manner, the prior-art ornaments such as necklaces, bracelets or the like have the following problem. That is, since the prior-art ornaments such as necklaces, bracelets or the like use the connecting element 92 upon connection of the fastener 93 and the wire 90 to each other, the connecting element 92 is bulky and becomes an obstacle or a nuisance. Further, the weight of the connecting element 92 increases the weight of the entire ornament. Particularly, in a case where the wire 90 is made to a multiple connecting structure such as two-connection, three-connection or the like structure, the connecting elements are large-sized in keeping therewith and increase in number. Thus, the above-described disadvantage is conspicuous. Moreover, the prior-art ornaments have the following problem. That is, in the prior-art ornaments, the connecting element 92 is conspicuous, and the original functions of the necklaces or the bracelets which impart ornamentation by the jewels 91 is reduced. Furthermore, the jewels are damaged or flawed due to the fact that the connecting element 92 is in contact with the jewels 91.

OBJECTS OF THE INVENTION

An object of the invention is to provide a wire for ornaments which solves the above-discussed disadvantages and problems, and which is made of a structure capable of being directly connected to a fastener, whereby the wire is not damaged in ornamentation and without the necessity of a separate connecting element.

An another object of the invention is to provide a wire for ornaments which, since a connecting element is dispensed with, reduces the weight of the ornaments per se even if the wire is made with a multiple connecting structure, and which considerably improves handling thereof.

Further, another object of the invention is to provide a wire for ornaments in which contact between a connecting element and jewels does not mar the jewels, and damage is not imparted to the jewels.

Moreover, another object of the invention is to provide a wire for ornaments which simplifies and facilitates assembling of the ornaments without the necessity of complicated steps, since a connecting element is dispensed with.

SUMMARY OF THE INVENTION

The invention is arranged such that connecting rings which have metallic elongations as a whole, which are large in diameter, which have a flat shape or contour and which are formed respectively with through bores in a thickness direction are integrally formed at both ends of a wire, whereby the rings at the ends in the above-described arrangement can directly be connected to a fastener or the like through the through bore. Since the rings are flat in shape, ornamentation is not damaged. For this reason, it is not necessary to use a connecting element to cover or hide the ring. A connecting element such as a prior art one is not required. The wire for ornaments is light in weight and is easy to handle. The jewels are not damaged. Further, since the rings are larger in diameter than the elongation, the wire for ornaments has the function to prevent the jewels from falling off also in the case where the jewels are linked to each other.

Moreover, since packings are interposed respectively between the adjacent jewels which pass over the body of the wire and between the rings and the jewels at both ends in a linking direction, contact between the jewels with each other and contact between the jewels and the rings with each other are prevented to effectively prevent the jewels from being marred. Thus, abrasion or wear of the jewels is restrained.

Furthermore, the rings are so arranged as to process, in high temperature, ends of a body of the wire to make the ends to a ball shape. The balls are so urged as to be made to a flat shape. Subsequently, the through bores are punched or blanked in a thickness direction.

As metal which is used for the wire according to the invention, noble or precious metals such as gold, silver, platinum and the like including stainless steel, brass and the like can be selected. In case of the wire made of the noble metals or the brass, the wire per se has ornamentation and, accordingly, the wire can directly be applied to the necklaces or the bracelets. It is dispensed with to link jewels to each other.

BRIEF DESCRIPTION OF THE DRAWINGS

Other objects and advantages of the present invention in addition to those described above will sufficiently be understood by consideration of the explanation of the accompanying drawings.

In the drawings.

DETAILED DESCRIPTION OF THE PREFERRED EMBODIMENTS

Figure 1:
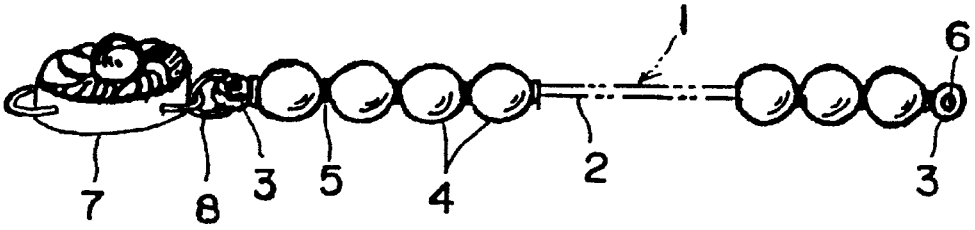
FIG. 1 is a perspective view of an embodiment to which the invention is applied.
Figure 2:
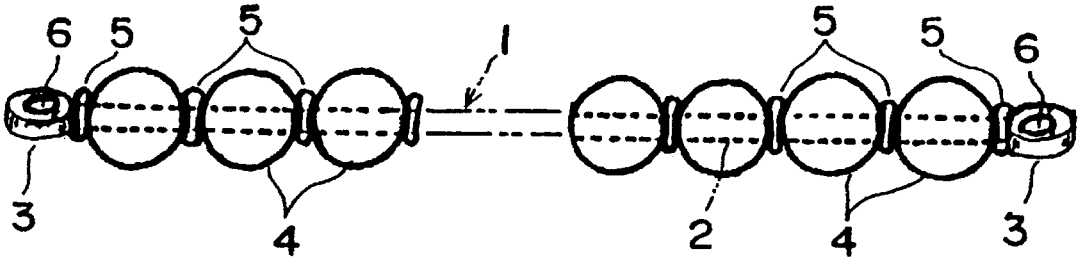
FIG. 2 is a perspective view of a principal portion of the embodiment of the invention.

FIGS. 1 and 2 show an embodiment of a necklace or a bracelet in which jewels are linked to each other, to which the invention is applied. In FIGS. 1 and 2, a wire 1 made of metal such as stainless steel or the like, is provided with an elongated body 2 and a pair of rings 3 integrally formed respectively at both ends of the body 2. The elongated body 2 is arranged such that jewels 4 such as pearls, crystals or the like are linked to each other. For this reason, the elongated body 2 passes through the plurality of jewels 4. In this case, packings 5 are interposed respectively between the adjacent jewels 4 and between the jewels 4 at both ends in a linking direction and the rings 3. Thus, the jewels 4, and the jewels 4 and the rings 3 are prevented from being in contact with each other, and abrasion of the jewels 4 is restrained.

Figure 3:
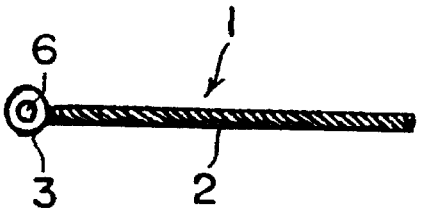
FIG. 3 is a front elevational view of a wire according to the invention.

The rings 3 are integrally formed respectively at both ends of the body 2. As shown in FIG. 3, each of the rings 3 is flat and larger in diameter than a diameter of the body 2. Thus, the jewels 4 which are linked to the body 2 are prevented from slipping off. Each of the rings 3 is formed therein with a through bore 6 in a direction of a thickness of the ring 3. The through bore 6 is used as a connecting element in case where the wire 1 is made to an endless annulus or ring. For example, in FIG. 1, a connecting ring 8 of a fastener 7 is inserted into the through bore 6 in the left-hand ring 3, whereby the connecting ring 8 is directly connected to the fastener 7. Against this, a hook element (not shown) is connected to the through bore 6 in the right-hand ring 3. The hook element and the fastener 7 are connected to each other, whereby the wire 1 is formed into an endless ring. Thus, the wire 1 is used as a necklace or a bracelet.

The embodiment is arranged such that the rings 3 are integrally formed respectively at both ends of the elongated body 2, and the ring 3 can directly be connected to the fastener 7 or the hook element. For this reason, the prior-art connecting element is dispensed with. Not only is the embodiment not bulky and does not serve as an obstacle or a nuisance, but also the weight thereof does not increase, and the embodiment is convenient to use. Further, the jewels are not wounded or injured by contact with the connecting element like the prior art. Moreover, since the ring 3 is flat and is inconspicuous, ornamentation of the jewels is not damaged, and it is possible to give a feeling of high class or exclusion. Furthermore, since a complicated step of connecting the connecting element is dispensed with, assembling of the ornaments can simply be performed.

Figure 4:
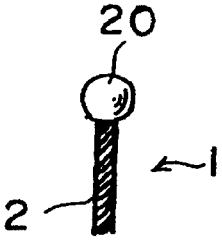
FIG. 4 is a front elevational view of a step of forming a ring according to the invention.
Figure 5:
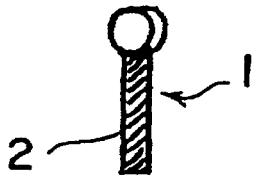
FIG. 5 is a front elevational view of a step of forming the ring according to the invention.
Figure 6:
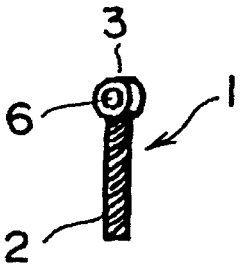
FIG. 6 is a front elevational view of the wire which is formed with a through bore in the ring.
Figure 7:
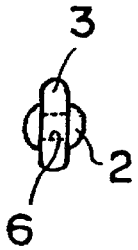
FIG. 7 is a top plan view of FIG. 6.

FIGS. 4 to 7 show an embodiment of a step of forming the ring 3. The body 2 of the wire 1 has an end thereof which is instantaneously processed in high temperature so as to be melted to thereby form a ball 20 (refer to FIG. 4). The ball 20 is urged so as to be made to a flat shape or contour larger in diameter than the body 2 (refer to FIG. 5). Subsequently, the through bore 6 is punched in a thickness direction thereof (refer to FIG. 6). Thus, as shown in FIGS. 6 and 7, it is possible to form the ring 3 integrally with the body 2, which is larger in diameter than the body 2, which has a flat shape or contour, and which has the through bore 6 in the thickness direction. In this case, a step illustrated in FIGS. 5 and 6 is such that setting is made within a mold, and the flattening and punching steps can simultaneously be performed. Thus, it is possible to shorten the steps, and processing is also improved efficiently. Since the ring 3 is made of metal the same in material as the body 2, the ring 3 has a strength of the order the same as that of the body 2, and forms a firm or stable connecting condition or state with respect to the body 2. Thus, the ring 3 is prevented from coming off from the body 2.

Figure 8:
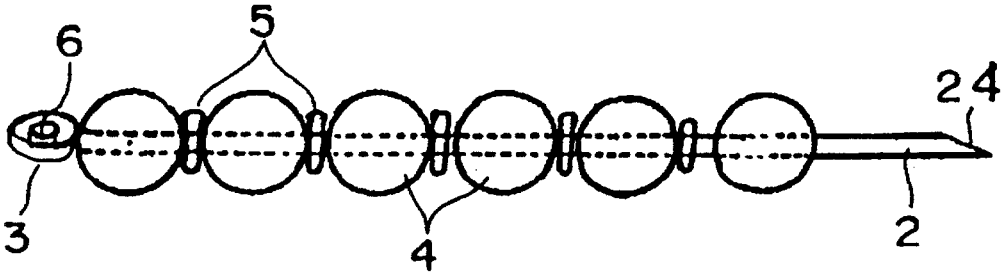
FIG. 8 is a front elevational view of an assembling step of ornaments.
Figure 9:
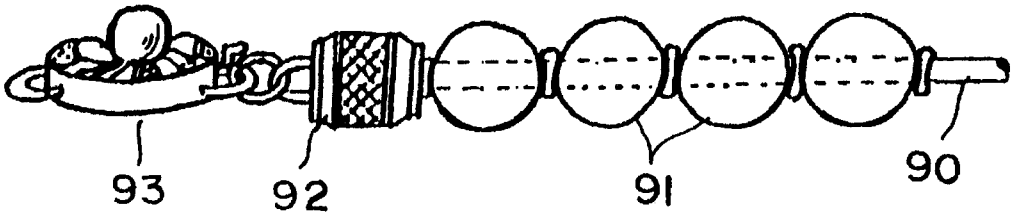
FIG. 9 PRIOR ART
FIG. 9 is a perspective view of the prior-art ornaments.
Figure 10:
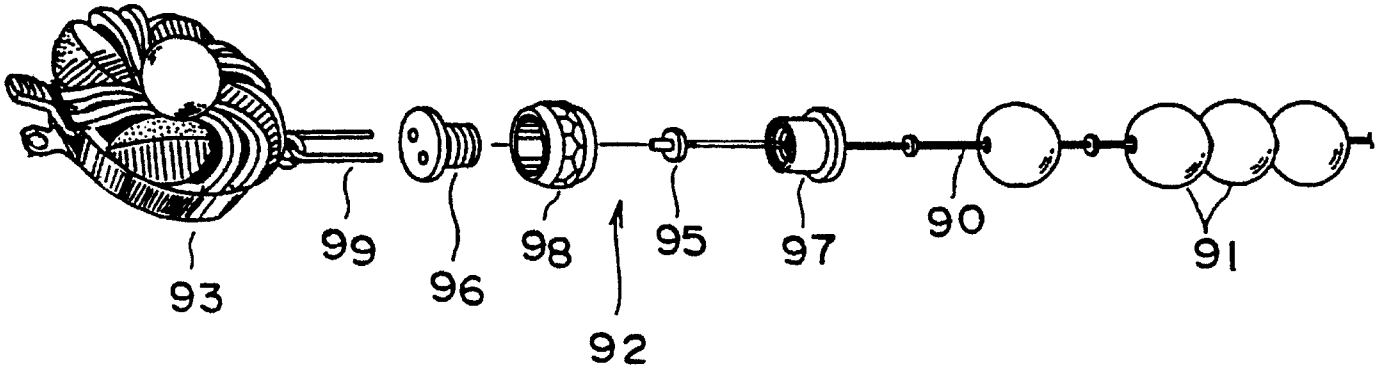
FIG. 10 PRIOR ART
FIG. 10 is an exploded perspective view of the prior-art ornaments.

FIG. 8 shows a step of manufacturing the necklace or the bracelet after the ring 3 has been formed. The ring 3 is formed on the side adjacent to one end of the body 2. A side 24 adjacent to the other end of the body 2 is made to an acute form. The side 24 adjacent to the other end is inserted subsequently into the packings 5 and the jewels 4. After caulking so that the jewels 4 are not loosened, the processing illustrated in FIGS. 4 to 6 is applied to the side 24 adjacent to the other end. Thus, as shown in FIG. 2, a state results in which the jewels 4 are linked to each other. The arrangement can be used as the necklace or the bracelet.

Although an embodiment has been described relative to ornaments in which the jewels are linked or joined to each other, the invention can be applied to ornaments in which the wire per se is made of noble metal such as gold, silver, platinum or the like, whereby the wire per se serves also as the necklace or the bracelet.

The wire for the ornaments according to the invention is arranged such that the wire is large in diameter and has a flat shape or contour, the rings each having the through bore in the thickness direction are formed at both ends, and the rings are so used as to directly be connected to the fastener or the like. Accordingly, the connecting element can be dispensed with. For this reason, the rings are not bulky and do not increase in weight. Handling is facilitated, ornamentation is improved, and the jewels are prevented from being wound or injured. Thus, the invention has such an advantage as to provide the wire of this kind which does not exist in the prior art and which is superior.

What is claimed is:

1. A wire for ornaments, comprising:

an elongated metal wire having a diameter and opposite ends; and metal rings integrally formed at said opposite ends of said elongated metal wire, each said metal ring having a generally cylindrical shape with a through bore therein and with a diameter larger than said diameter of said elongated metal wire;

said metal rings being formed by:

forming each said opposite end of said elongated metal wire into a ball shape by processing said opposite ends of said elongated metal wire in a high temperature;

forming said ball shaped ends into a generally cylindrical shape; and punching said through bores through said generally cylindrical shaped ends in a thickness direction thereof.

2. A wire for ornaments according to claim 1, wherein each said ornament has a plurality of jewels, with said elongated metal wire passing through said jewels, and further comprising packings interposed respectively between adjacent jewels.

3. A wire for ornaments according to claim 2, further comprising packings interposed between end ones of said jewels and respective ones of said rings.

4. A wire for ornaments according to claim 1, wherein each said ornament has a plurality of jewels, with said elongated metal wire passing through said jewels, and further comprising packings interposed between end ones of said jewels and respective ones of said rings.

5. A wire for ornaments according to claim 1, further comprising a fastener connected to said metal rings to form said ornament into a closed loop configuration.

6. A wire for ornaments according to claim 5, wherein said fastener includes a main body and two connecting rings secured thereto, each said connecting ring being connected with one said ring.

7. A wire for ornaments, comprising:

an elongated metal wire having a diameter and opposite ends;

metal rings integrally formed at said opposite ends of said elongated metal wire, each said metal ring having a generally cylindrical shape with a through bore therein and with a diameter larger than said diameter of said elongated metal wire, said metal rings being formed by:

forming each said opposite end of said elongated metal wire into a ball shape by processing said opposite ends of said elongated metal wire in a high temperature;

forming said ball shaped ends into a generally cylindrical shape; and punching said through bores through said generally cylindrical shaped ends in a thickness direction thereof; and a fastener connected to said metal rings to form said ornament into a closed loop configuration.

8. A wire for ornaments according to claim 7, wherein each said ornament has a plurality of jewels, with said elongated metal wire passing through said jewels, and further comprising packings interposed respectively between adjacent jewels.

9. A wire for ornaments according to claim 8, further comprising packings interposed between end ones of said jewels and respective ones of said rings.

10. A wire for ornaments according to claim 7, wherein each said ornament has a plurality of jewels, with said elongated metal wire passing through said jewels, and further comprising packings interposed between end ones of said jewels and respective ones of said rings.

11. A wire for ornaments according to claim 7, wherein said fastener includes a main body and two connecting rings secured thereto, each said connecting ring being connected with one said ring.

12. A method for making wire for ornaments comprising the steps of:

forming an elongated metal wire having a diameter and opposite ends; and integrally forming metal rings at said opposite ends of said elongated metal wire, such that each said metal ring has a generally cylindrical shape with a through bore therein and with a diameter larger than said diameter of said elongated metal wire;

said step of integrally forming includes the steps of:

forming each said opposite end of said elongated metal wire into a ball shape by processing said opposite ends of said elongated metal wire in a high temperature;

forming said ball shaped ends into a generally cylindrical shape; and punching said through bores through said generally cylindrical shaped ends in a thickness direction thereof.

* * * * *

UNITED STATES PATENT AND TRADEMARK OFFICE

CERTIFICATE OF CORRECTION

PATENT NO. : 5,528,909

DATED : June 25, 1996

INVENTOR(S) : Yasuhiko Tonokawa

It is certified that error appears in the above-indentified patent and that said Letters Patent is hereby corrected as shown below:

On the title page, items [19] and [76]:

Change the inventor's surname from "TONAKAWA" to --TONOKAWA--.

Signed and Sealed this

Twenty-second Day of October, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,528,909

DATED : June 25, 1996

INVENTOR(S) : Yasuhiko Tonakawa

It is certified that error appears in the above-indentified patent and that said Letters Patent is hereby corrected as shown below:

On title page, items [19] and [76],

Change the inventor's surname from "TONAKAWA" to --TONOKAWA--.

Signed and Sealed this

First Day of April, 1997

*Attest:*

*Attesting Officer*

BRUCE LEHMAN

*Commissioner of Patents and Trademarks*